US008529295B2

(12) United States Patent
Sasaki et al.

(10) Patent No.: US 8,529,295 B2
(45) Date of Patent: Sep. 10, 2013

(54) SURFACE MOUNT MULTI-CONNECTOR AND ELECTRONIC APPARATUS HAVING THE SAME

(75) Inventors: Daisuke Sasaki, Osaka (JP); Takayuki Nagata, Osaka (JP)

(73) Assignee: Hosiden Corporation, Osaka (JP)

( * ) Notice: Subject to any disclaimer, the term of this patent is extended or adjusted under 35 U.S.C. 154(b) by 0 days.

(21) Appl. No.: 13/165,612

(22) Filed: Jun. 21, 2011

(65) Prior Publication Data

US 2012/0009824 A1 Jan. 12, 2012

(30) Foreign Application Priority Data

Jul. 6, 2010 (JP) ..... 2010-154028

(51) Int. Cl.
*H01R 13/648* (2006.01)

(52) U.S. Cl.
USPC ..... 439/607.01; 439/660

(58) Field of Classification Search
USPC ..... 439/607.01, 638, 79
See application file for complete search history.

(56) References Cited

U.S. PATENT DOCUMENTS

| | | | | |
|---|---|---|---|---|
| 5,256,085 | A | 10/1993 | Tan et al. | |
| 5,547,384 | A * | 8/1996 | Benjamin | 439/79 |
| 5,641,308 | A * | 6/1997 | Bixler et al. | 439/660 |
| 5,975,917 | A | 11/1999 | Wang et al. | |
| 6,019,631 | A * | 2/2000 | Chen | 439/541.5 |
| 6,159,040 | A * | 12/2000 | Chang et al. | 439/541.5 |
| 6,354,886 | B1 * | 3/2002 | Yu | 439/701 |
| 6,585,540 | B2 * | 7/2003 | Gutierrez et al. | 439/620.19 |
| 6,736,651 | B2 * | 5/2004 | Ho | 439/79 |
| 6,979,228 | B2 * | 12/2005 | Zhang | 439/660 |
| 7,275,955 | B2 * | 10/2007 | Ko | 439/498 |
| 7,407,417 | B2 * | 8/2008 | Pepe et al. | 439/676 |
| 7,540,788 | B2 * | 6/2009 | Murphy et al. | 439/676 |

(Continued)

FOREIGN PATENT DOCUMENTS

| | | |
|---|---|---|
| EP | 1 274 151 | 1/2003 |
| JP | 2004-537836 | 12/2000 |
| WO | WO 03/012928 | 2/2000 |

OTHER PUBLICATIONS

Extended European Search Report (EESR) issued on Sep. 29, 2011 by the European Patent Office for corresponding European patent application No. 11171712.0.

*Primary Examiner* — Amy Cohen Johnson
*Assistant Examiner* — Vladimir Imas
(74) *Attorney, Agent, or Firm* — David N. Lathrop

(57) ABSTRACT

A surface mount multi-connector having movable contact sections with high contact reliability and providing connection portions with high coplanarity. The surface mount multi-connector includes a first body in which a plurality of first contacts having movable contact sections and end sections that extend oppositely to each other are held by insert molding, a second body in which a plurality of second contacts having movable contact sections and end sections that extend oppositely to each other are held by insert molding, and a third body that incorporates the first body with which the second body has been coupled so that the movable contact sections of the second contacts and the movable contacts section of the first contacts face in the same direction. Tips ahead of the movable contact sections of the first and second contacts elastically mate with catching parts formed on the inner wall of the third body, and connection portions of the end sections of the first contacts and connection portions of the end sections of the second contacts lie in a same plane.

6 Claims, 21 Drawing Sheets

(56) References Cited

U.S. PATENT DOCUMENTS

| | | | | |
|---|---|---|---|---|
| 7,748,999 | B1 * | 7/2010 | Sun et al. | 439/79 |
| 7,892,027 | B2 * | 2/2011 | Mao et al. | 439/607.25 |
| 2003/0186586 | A1 * | 10/2003 | Gutierrez et al. | 439/607 |
| 2005/0009401 | A1 * | 1/2005 | Hu et al. | 439/607 |
| 2007/0254529 | A1 * | 11/2007 | Pepe et al. | 439/676 |
| 2011/0201222 | A1 * | 8/2011 | Potters | 439/345 |
| 2011/0294362 | A1 * | 12/2011 | Lim et al. | 439/692 |

* cited by examiner

SURFACE MOUNT MULTI-CONNECTOR AND ELECTRONIC APPARATUS HAVING THE SAME

TECHNICAL FIELD

The present invention relates to a surface mount multi-connector connected electrically and an electronic apparatus having a surface mount multi-connector.

BACKGROUND ART

Japanese Patent Application Laid Open No. 2004-537836 discloses the prior-art one-surface mount multi-connector 10. The creation method and structure of one-surface mount multi-connector 10 disclosed in this patent literature will be described with reference to FIG. 1.

First, a plurality of first contacts 12 and a plurality of second contacts 22 are formed by punching a metal plate 90. Next, the plurality of first contacts 12 and the plurality of second contacts 22 are placed in a cavity, and then molten plastic etc. is injected into the cavity. The plurality of first contacts 12 and the plurality of second contacts 22 are covered with molted plastic, and the molted plastic is solidified into a desired shape to insert-mold a first body 11 having the plurality of first contacts 12 and a second body 21 having the plurality of second contacts 22.

The first body 11 and the second body 21 are disconnected from the metal plate 90. A concave portion 11*a* of the first body 11 and a projection (not shown) of the second body 21 mate with each other to form a body assembly 31. Next, a cover 51 is attached to a body cantilever part 34 of the body assembly 31 to form a connector semi-fabricated body 52. The connector semi-fabricated body 52 is inserted into the mold and a connector housing main body 61 is molded so as to cover part of the first body 11, the second body 21, the cover 51, the first contacts 12 and the second contacts 22. As shown in FIG. 1, the connector housing main body 61 extends downward to the lower end of the connection portions of the first contacts 12 and the second contacts 22. Finally, a cover 71 is attached. The cover 71 is partially supported by the connector housing main body 61 and encloses both the connector housing main body 61 and an inner cover 51.

This structure allows the connection portions of the first contacts 12 and the second contacts 22 to be placed on the same plane.

SUMMARY OF THE INVENTION

Since the prior art uses insert molding to secure the first contacts 12 and the second contacts 22 to the first body 11 and the second body 21, respectively, it is difficult to flexibly respond to the size of the corresponding connector, possibly causing loose connection etc.

To prevent such loose connection etc., preload needs to be applied to the first contacts 12 and the second contacts 22 when the first contacts 12 and the second contacts 22 are of movable type. However, because the first body 11 and the second body 21 are created by insert molding, it is difficult to use these bodies to apply preload to the first contacts 12 and the second contacts 22.

Alternatively, in a method of inserting contacts into a molded body using press-fitting instead of insert molding, it is difficult to maintain the coplanarity (uniformity and planarity of the lowest surface of components or pins with respect to the mounting surface) of the connection portions with respect to the printed circuit board.

For these reasons, it is difficult to use two bodies to achieve a compact narrow-pitch connector with two rows of contacts while keeping the connection portions of movable contacts on the same plane.

An object of the present invention is to provide a surface mount multi-connector that has movable contact sections with high contact reliability and provides high coplanarity for the connection portions.

To address the problems described above, a surface mount multi-connector according to an embodiment of the present invention has a first body in which a plurality of first contacts having movable contact sections and end sections that extend oppositely to each other are held by insert molding, a second body in which a plurality of second contacts having movable contact sections and end sections that extend oppositely to each other are held by insert molding, and a third body that incorporates the first body with which the second body has been coupled so that the movable contact sections of the second contacts and the movable contact sections of the first contacts face in the same direction, in which tips ahead of the movable contact sections of the first contacts and tips ahead of the movable contact sections of the second contacts elastically mate with catching parts formed on an inner wall of the third body, and connection portions of the end sections of the first contacts and connection portions of the end sections of the second contacts lie in a same plane.

Effects of the Invention

The present invention has the effect of providing the movable contact sections with high contact reliability and the connection portions with high coplanarity.

DETAILED DESCRIPTION OF THE EMBODIMENTS

Embodiments of the present invention will be described in detail below.

Surface Mount Multi-Connector 100

Figure 3:
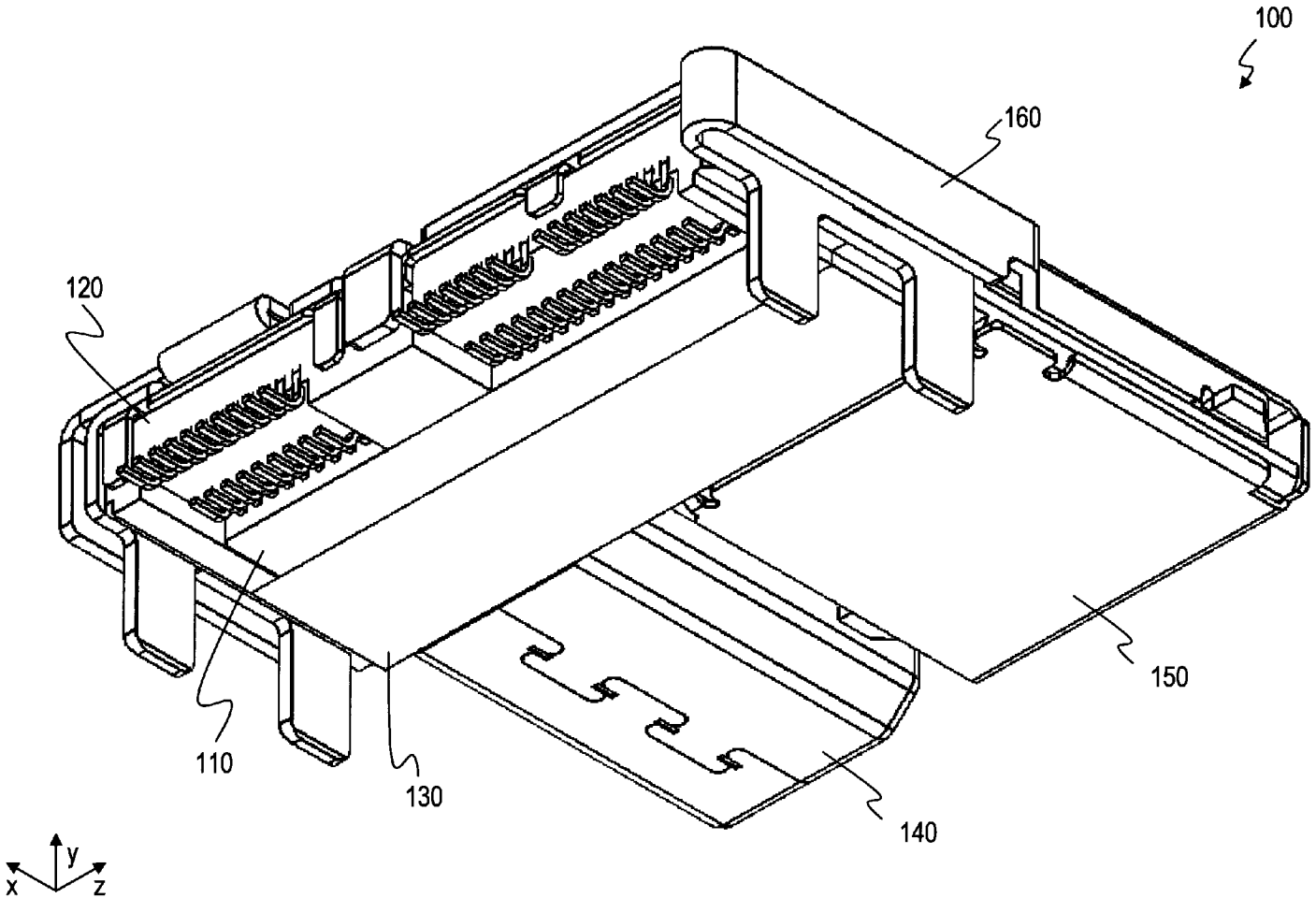
FIG. 3 is a perspective view showing the back side, left side, and bottom face of the surface mount multi-connector 100.
Figure 4:
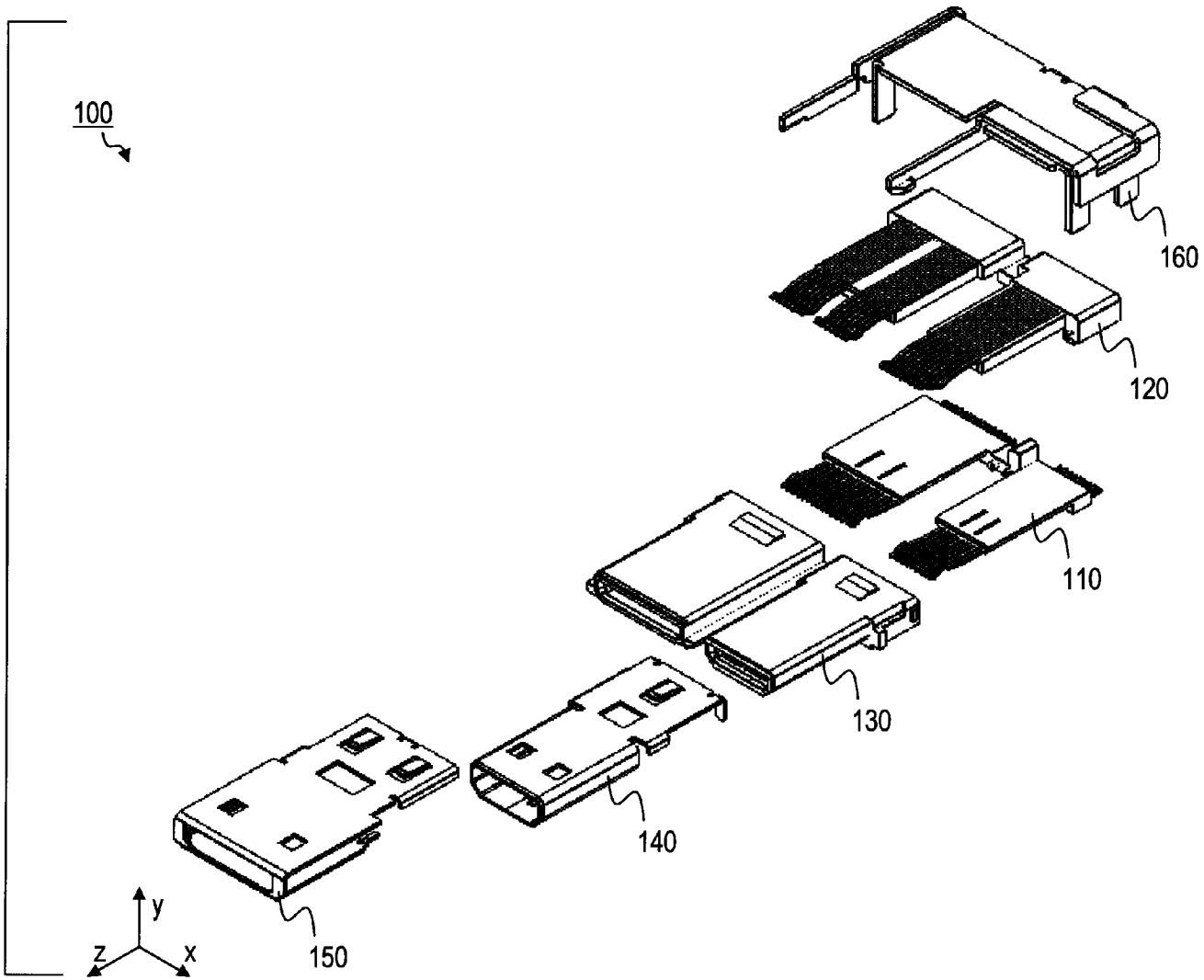
FIG. 4 is an exploded perspective view showing the front side, right side, and top face of the surface mount multi-connector 100.

A surface mount multi-connector 100 will be described with reference to FIGS. 2, 3, and 4. In the surface mount multi-connector 100, the side facing a printed circuit board is assumed to be the bottom surface and the side into which the corresponding connector is inserted is assumed to be the front side.

The surface mount multi-connector 100 includes a first body 110, a second body 120, a third body 130, a first cover 140, a second cover 150, and a third cover 160.

A plurality of the first contacts 112 are arranged in the first body 110 made of synthetic resin such as polyethylene (PE), polypropylene (PP), polyvinylchloride (PVC), etc. and held by insert molding. In the example shown in FIG. 5, the first body 110 is substantially rectangular plate shaped. The movable contact sections 112*a* at one end of the first contacts 112 and the end sections 112*b* at the other end extend oppositely to each other from the first body 110.

Similarly, a plurality of the second contacts 122 are arranged in the second body 120 made of synthetic resin such as polyethylene (PE), polypropylene (PP), polyvinylchloride (PVC), etc. and held by insert molding. In the example shown in FIG. 6 (perspective view seen from the bottom), the second body 120 is substantially rectangular plate shaped. The movable contact sections 122*a* at one end of the second contacts 122 and the end sections 122*b* at the other end extend oppositely each other from the second body 120.

Figure 7:
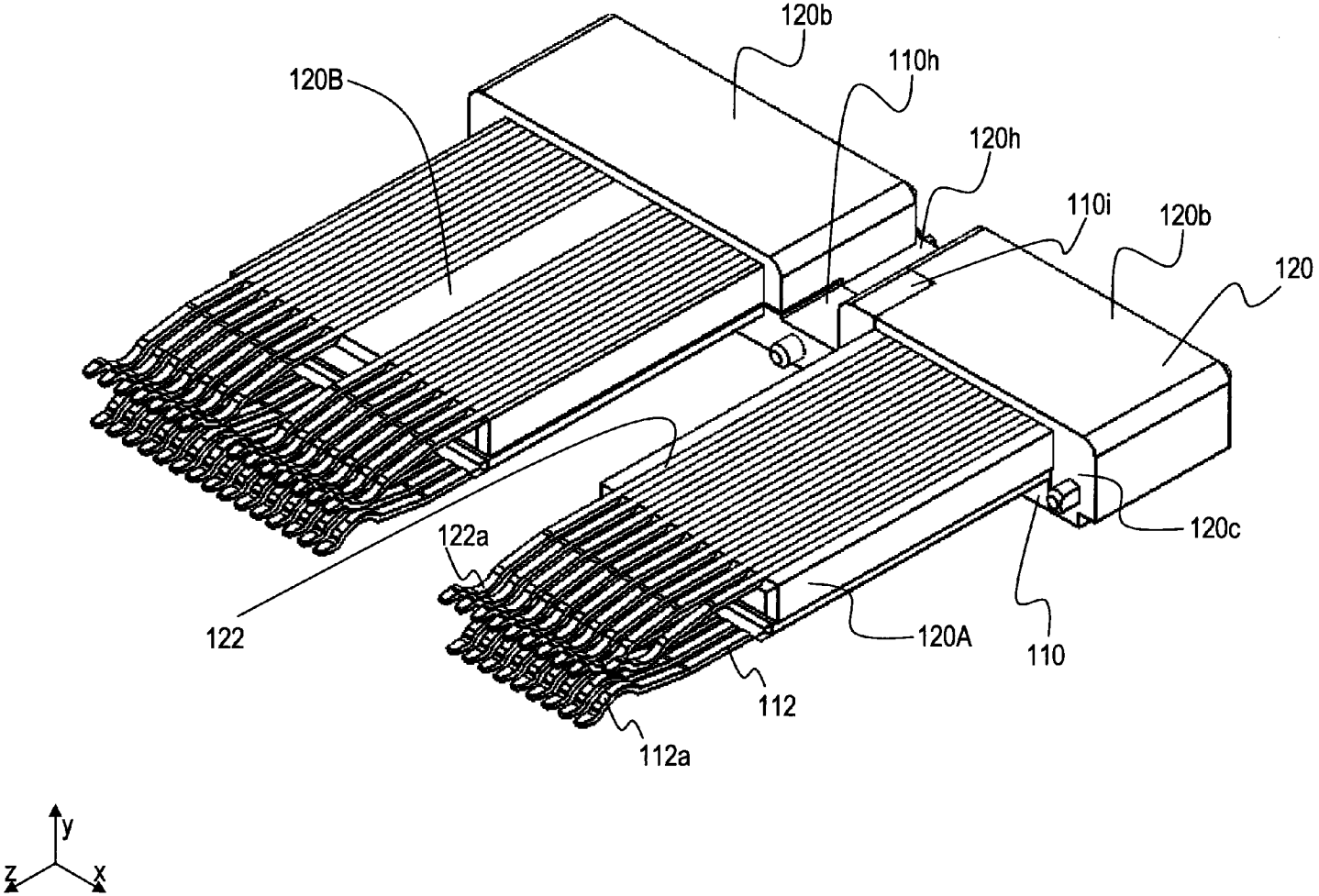
FIG. 7 is a perspective view showing the front side, right side, and top face of the first body with which the second body has been coupled.

The third body 130 is formed as a molded component made of synthetic resin such as polyethylene (PE), polypropylene (PP), polyvinylchloride (PVC), etc. As shown in FIG. 7, the second body 120 is coupled with the first body 110 so that the movable contact sections 112*a* of the first contacts 112 and the movable contact sections 122*a* of the second contacts 122 face in the same direction (toward the front side). In other words, the second body 120 is put on the first body 110. The first body 110 with which the second body 120 is coupled is inserted and incorporated into the third body 130 shown in FIG. 8 (perspective view seen from the back side), which is hollow rectangular parallelepiped-shaped.

About Preload

Figure 9:
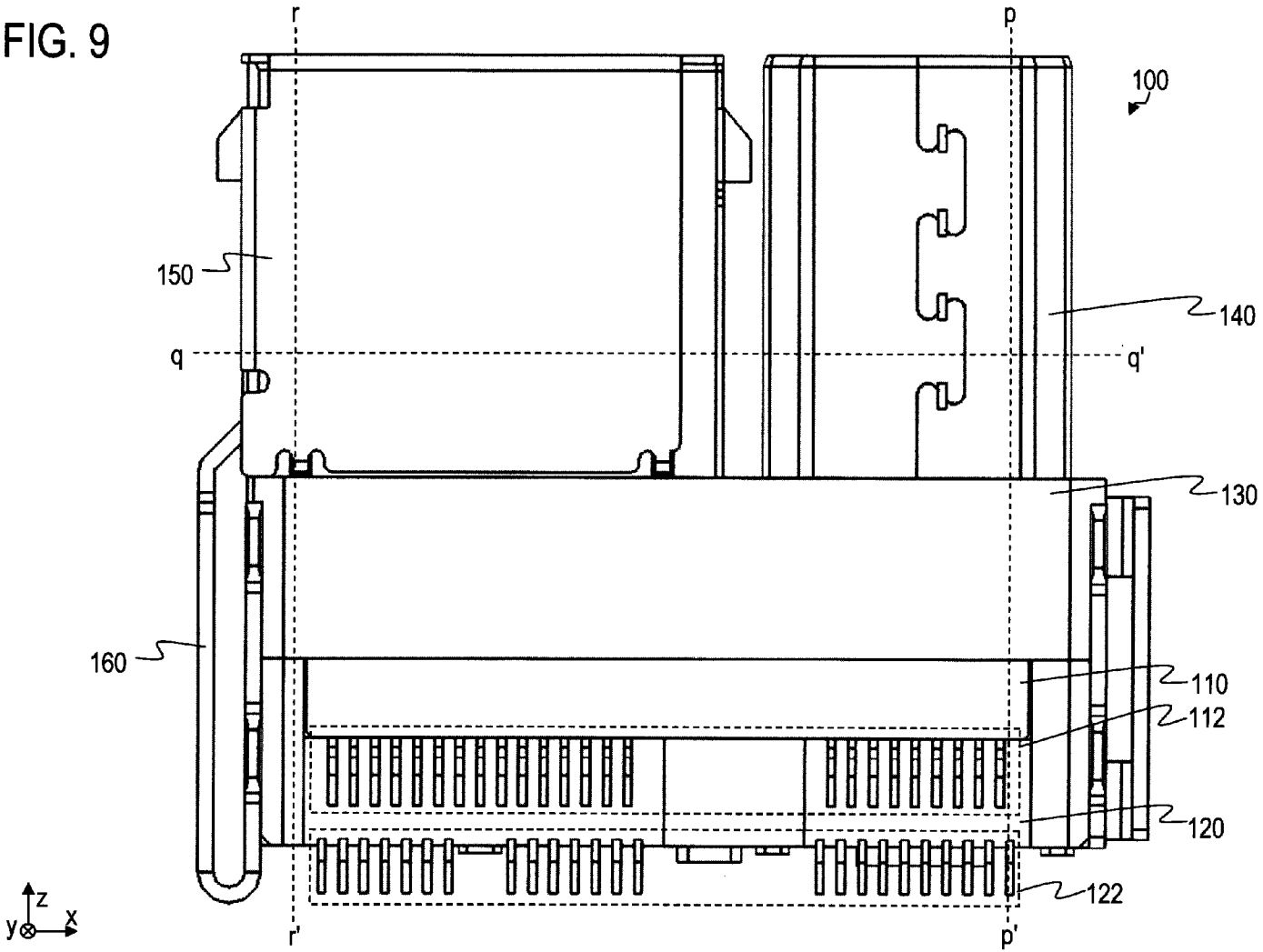
FIG. 9 is a bottom view of the surface mount multi-connector 100.
Figure 10:
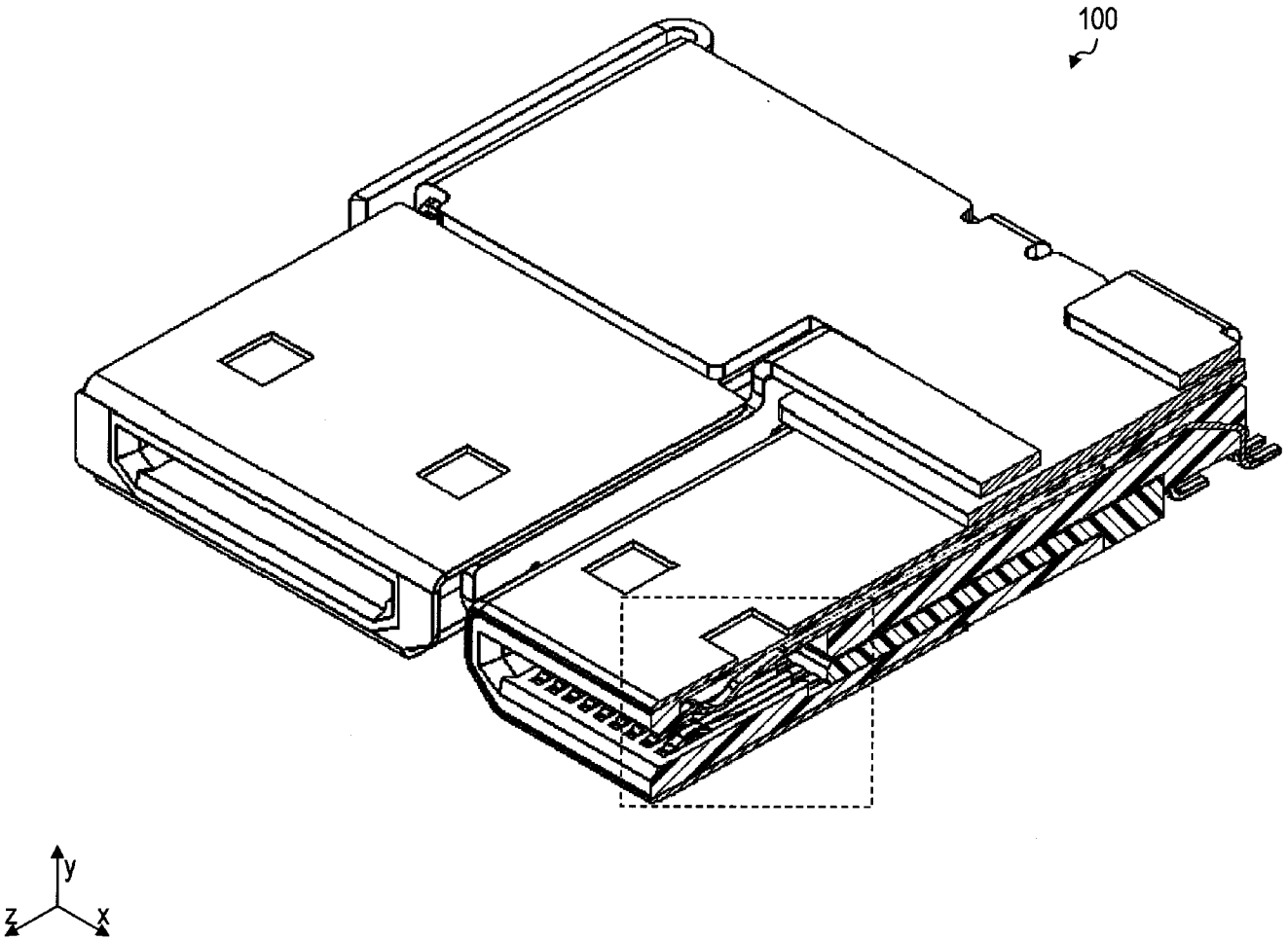
FIG. 10 is a perspective view showing the cross section p-p' in FIG. 9.
Figure 11:
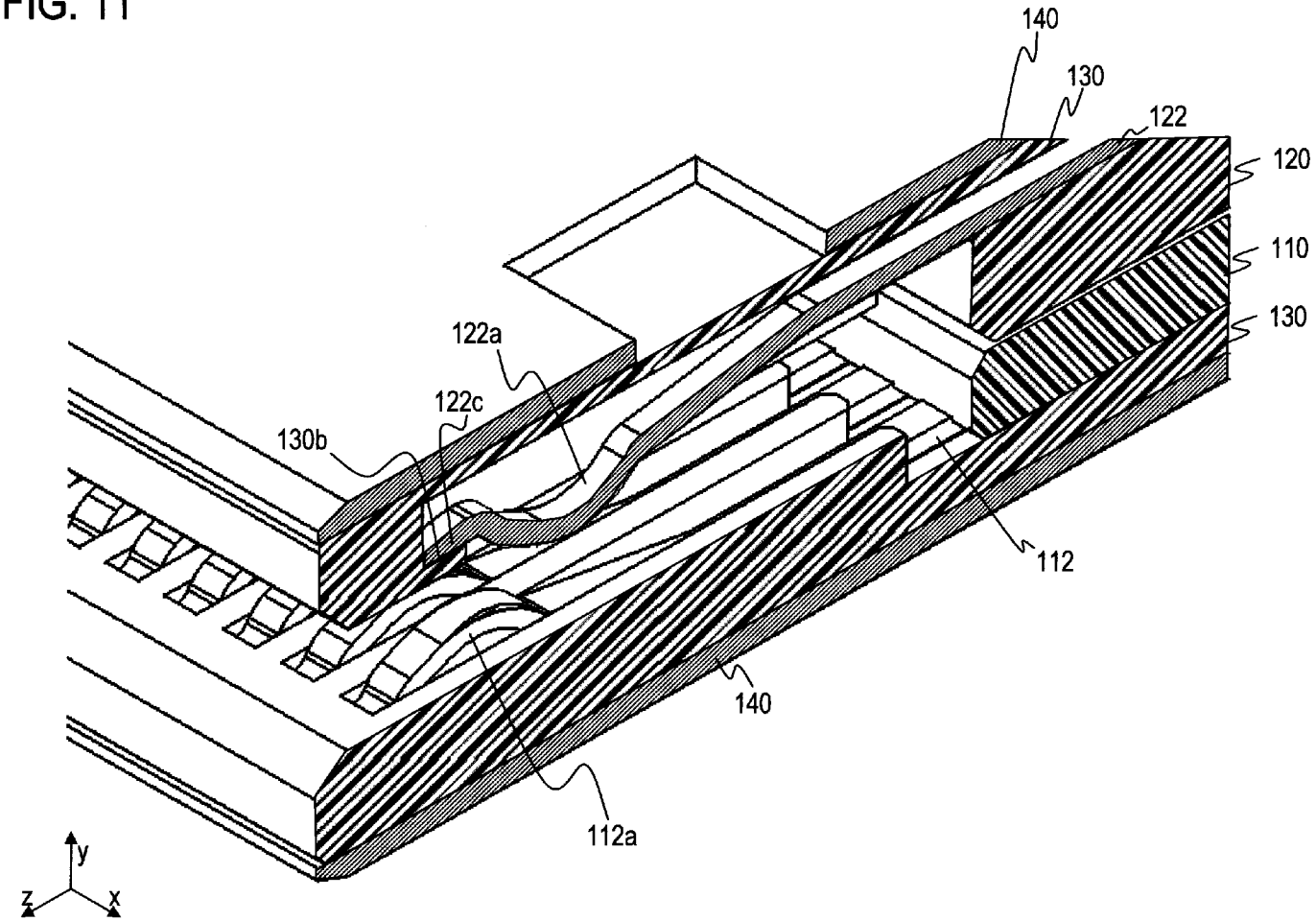
FIG. 11 is an enlarged view of the part enclosed by the dotted line in FIG. 10.
Figure 12:
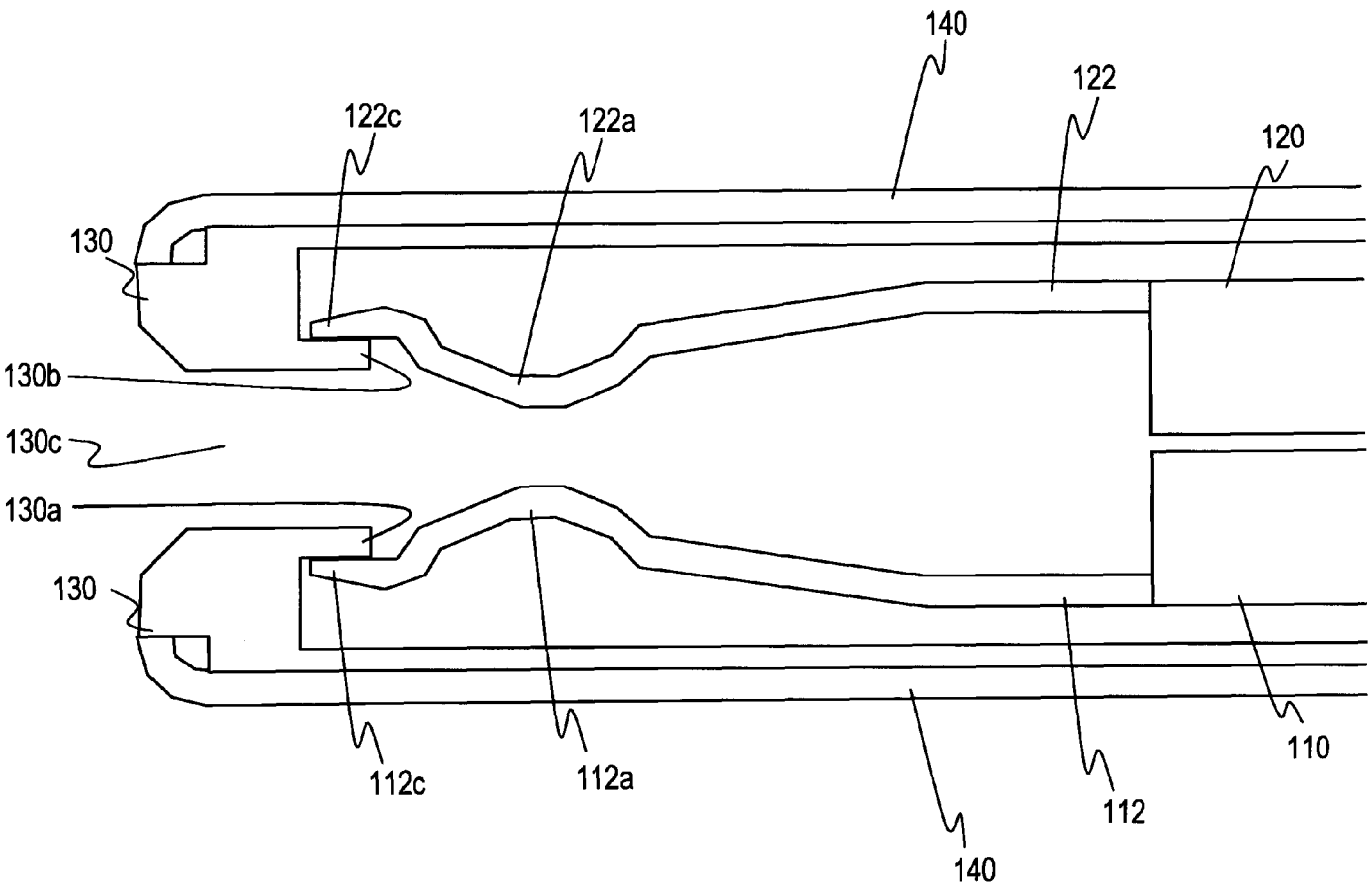
FIG. 12 is a view showing the state where tips mate with catching parts.

FIG. 9 is a bottom view of the surface mount multi-connector 100; FIG. 10 is a perspective view showing the cross section p-p' in FIG. 9; FIG. 11 is an enlarged view of the part enclosed by the dotted line in FIG. 10; FIG. 12 shows the state where the tips mate with catching parts. When the first body 110 and the second body 120 are inserted into the third body 130, the tips 112*c* and 122*c* ahead of the movable contact sections 112*a* and 122*a* of the first body 110 and the second body 120 mate with catching parts 130*a* and 130*b* formed on the inner wall of the third body 130, respectively. This structure gives preload to each of the movable contact sections 112*a* and 122*a* of the contacts 112 and 122.

One end of the first contact 112 and one end of the second contact 122 are bent toward the connection interface between the first body 110 and the second body 120 to form the movable contact parts 112*a* and 122*a* (see FIG. 7). The first body 110 and the second body 120 are inserted, from the side of the movable contact sections 112*a* and 122*a*, into opening 130*d* in the surface (back side) opposite to the an insertion opening 130*c* (see FIG. 2) of the hollow rectangular parallelepiped-shaped third body 130 (see FIGS. 4, 7, and 8). The corresponding connector is inserted into the insertion opening 130*c* (see FIG. 2). Grooves 130*e* and 130*f* are formed in the inner surface of the third body 130. The inner surface faces the surfaces of the first body 110 and the second body 120. The Grooves 130*e* and 130*f* are formed so as to face the first contacts 112 and the second contacts 122, respectively. The ends of the grooves 130*e* and 130*f* on the side of the insertion opening 130*c* are covered with the parts present on the same surface as the inner surface of the third body 130. The cover parts are the catching parts 130*a* and 130*b* (see FIGS. 11 and 12).

Figure 13:
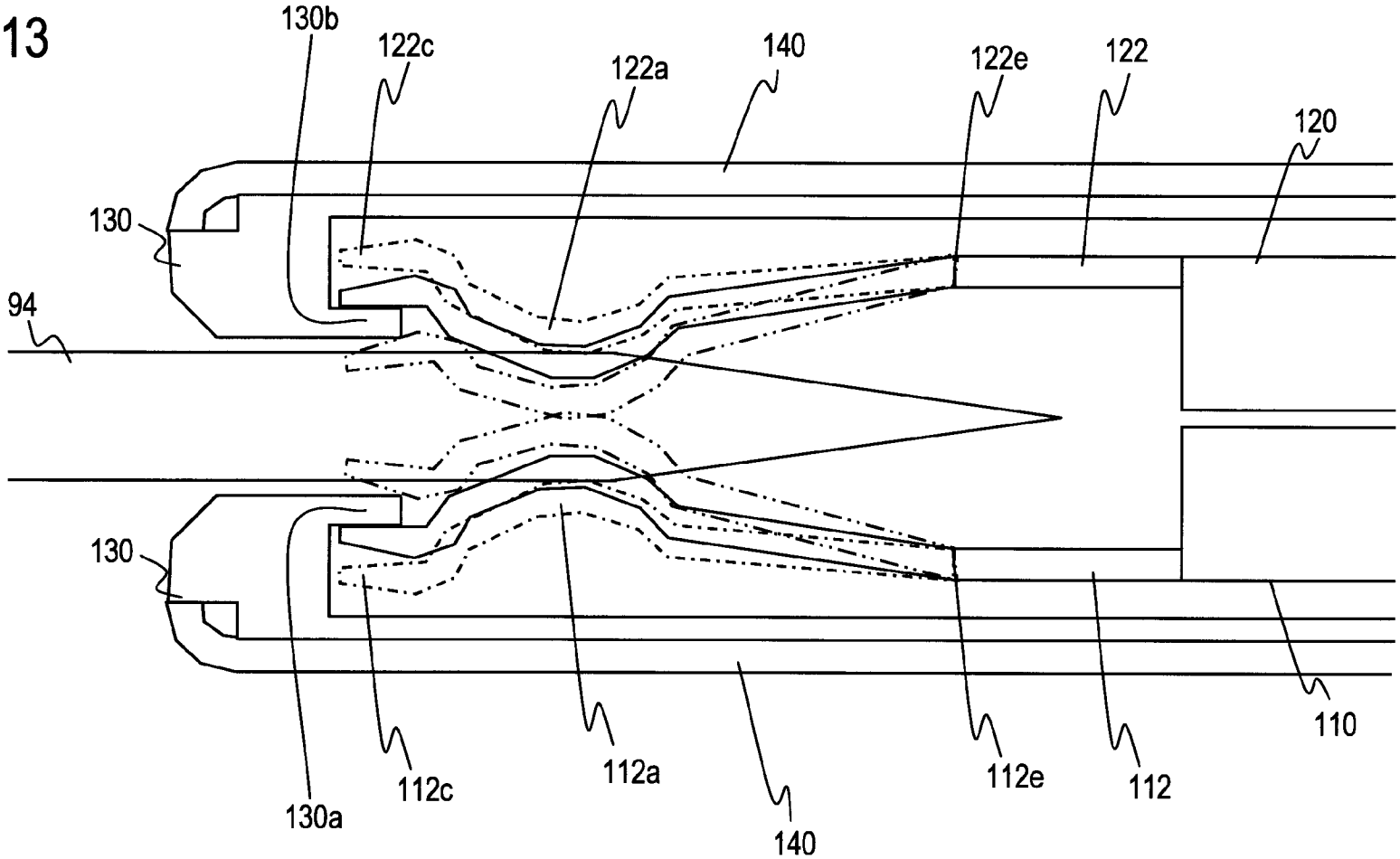
FIG. 13 is a view describing the method of mating the tips with the catching parts.

When the movable contact sections 112*a* and 122*a* are not loaded, the tips 112*c* and 122*c* are located inside the catching parts 130*a* and 130*b* as shown by the chain double-dashed lines in FIG. 13. Before the first body 110 and the second body 120 are inserted into the third body 130, a jig 94 is inserted into the insertion opening 130*c*. The jig 94 mates with the movable contact sections 112*a* and 122*a*, and lets the movable contact sections 112*a* and 122*a* elastically deform outward, as indicated by the dashed lines in FIG. 13. After the first body 110 and the second body 120 are inserted, the jig 94 is removed from the insertion opening 130*c*. The tip 112*c* of each of the first contacts 112 and the tip 122*c* of each of the second contacts 122 are press-fit and elastically mate with the catching parts 130*a* and 130*b*, respectively, as shown by the solid lines in FIG. 13. That is, preload is applied to each of the movable contact sections 112*a* and 122*a* of the first contacts 112 and the second contacts 122. The preload may be increased by slightly bending middle parts near the movable contact sections 112*a* and 122*a* toward the connection interface between the first body 110 and the second body 120 at bending points 112*e* and 122*e* in the first contacts 112 and the second contacts 122, respectively.

About Coplanarity

Figure 14:
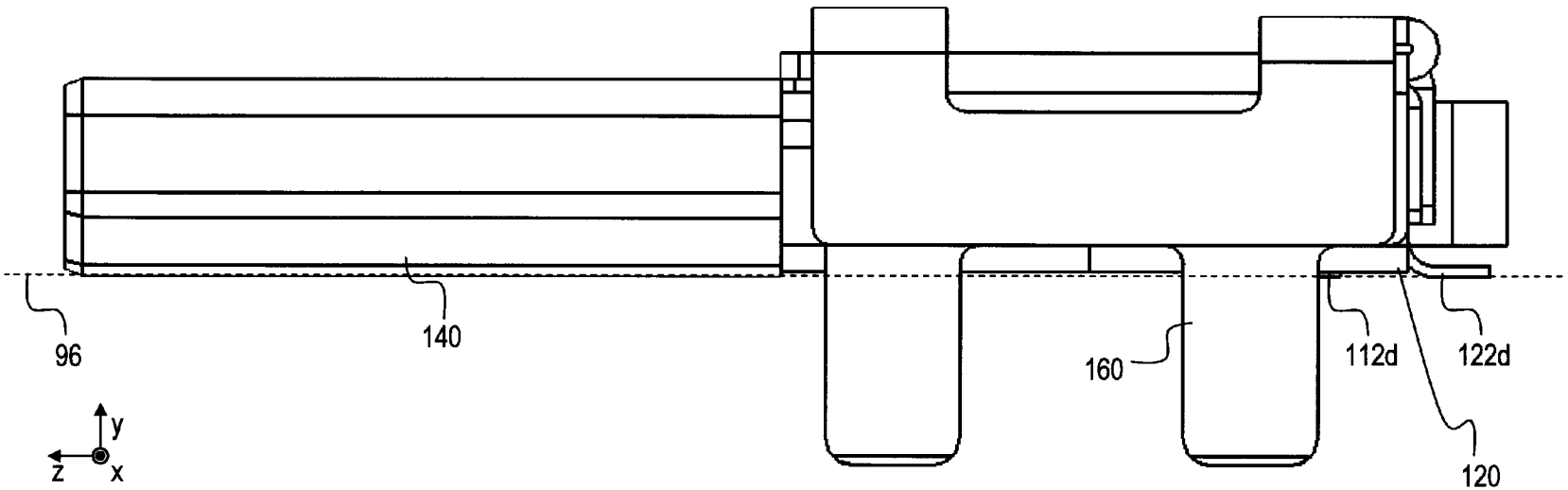
FIG. 14 is a right side view of the surface mount multi-connector 100.
Figure 15:
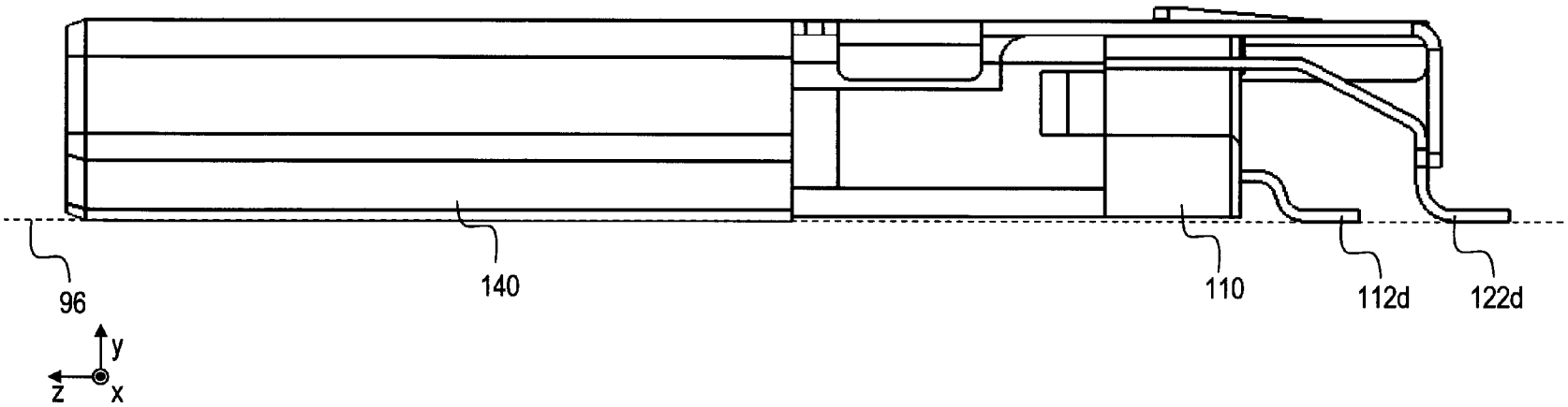
FIG. 15 is a right side view of the surface mount multi-connector 100 when a third cover and the second body in FIG. 14 are assumed to be transparent.

A surface 96 (referred to below as the mounting surface 96) of the surface mount multi-connector 100 faces the printed circuit board during mounting. The mounting surface 96 is parallel to the surface of the first body 110 opposite to the second body 120 and is out of contact with the first body 110, in this example. FIG. 14 is the right side view of the surface mount multi-connector 100; FIG. 15 is a right side view of the surface mount multi-connector 100 when the third cover 160 and the second body 120 in FIG. 14 are assumed to be transparent.

The end sections 112*b* of the first contacts 112 and the end sections 122*b* of the second contacts 122 are bent toward the mounting surface 96 at the back side of the first body 110 and the second body 120, respectively, and then bent backward on the mounting surface 96 to form connection parts 112*d* and 122*d*. At this time, the connection parts 112*d* and 122*d* are present on the same surface (the mounting surface 96). As shown in FIG. 9, the first contacts 112 and the second contacts 122 are displaced in the right and left direction seen from the direction (y-axis direction) in which the second body 120 is coupled with the first body 110. In addition, the positions of the connection parts 112*d* and 122*d* on the mounting surface 96 are displaced in the back and forth direction.

When, for example, the first contacts 112 and the second contacts 122 are formed by punching a metal plate, the coplanarity of the connection parts 112*d* and 122*d* with respect to the mounting surface 96 can be improved.

Details of the First Body 110

Figure 5:
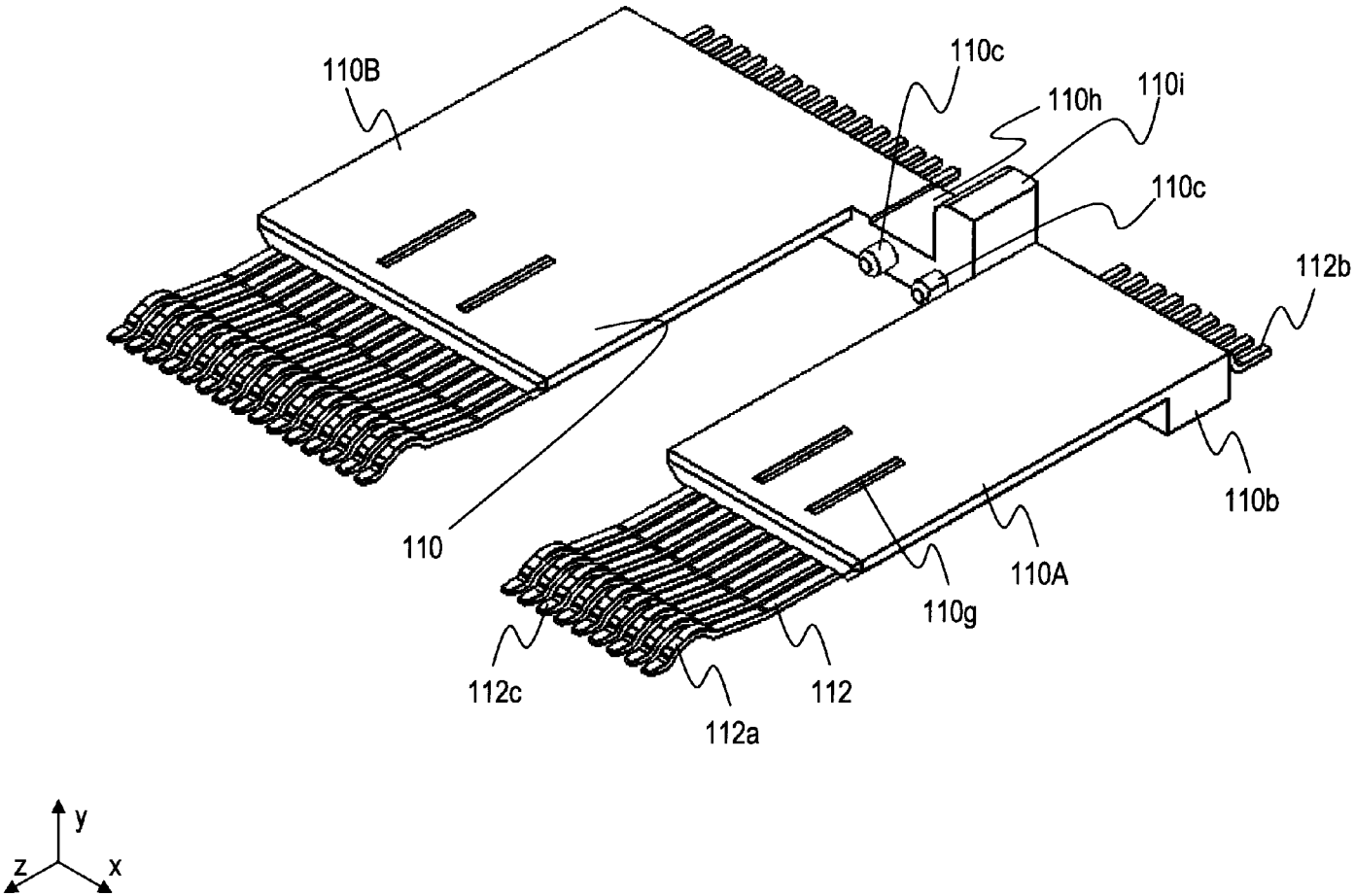
FIG. 5 is a perspective view showing the front sides, right sides, and top faces of a first body and first contacts.

In this example, there is a thick section 110*b* on the surface facing the mounting surface 96 at the end of the first body 110 from which the end sections 112*b* extend (see FIG. 5). Although not shown in the drawing, the first contacts 112 are insert-molded so that one surface of each of the first contacts 112 is exposed on the same surface as the surface of each of plate sections 110A and 110B of the first body 110 facing the mounting surface 96.

In this example, a plurality of projections 110*c* are arranged in the direction in which the first contacts 112 are arranged, on the front side (surface facing the insertion opening for the corresponding connector) of the thick section 110*b* of the first body 110.

Details of the Second Body 120

Figure 6:
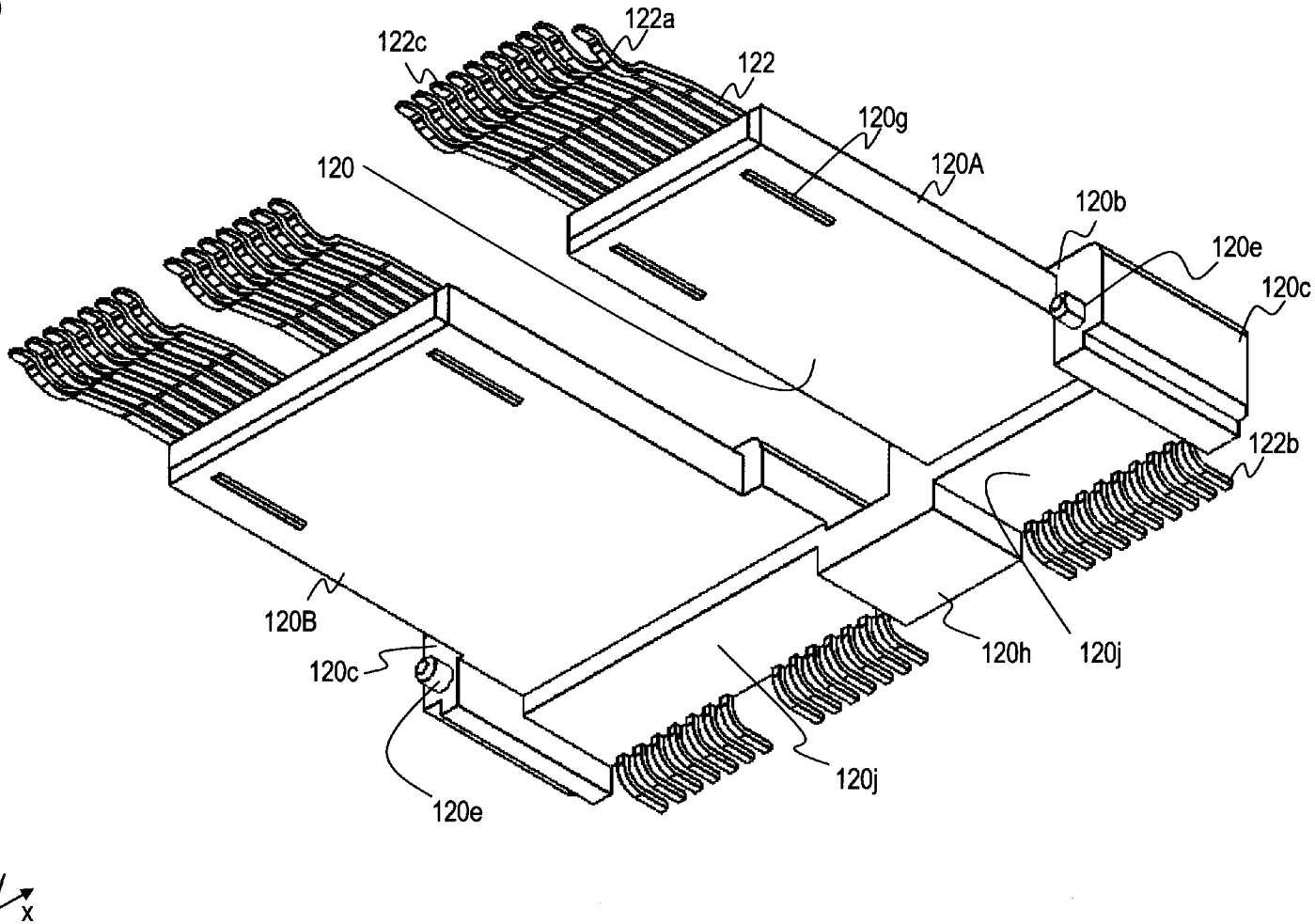
FIG. 6 is a perspective view showing the front sides, right sides, and bottom faces of a second body and second contacts.

On the other hand, there is a thick section 120*b* on the surface opposite to the mounting surface 96 at the end of the second body 120 from which the end sections 122*b* extend (see FIGS. 6 and 7). Side walls 120*c* are formed integrally with the second body 120 on both sides of the thick section 120*b* in the direction in which the second contacts 122 are arranged so as to extend toward the mounting surface 96. A projection 120*e* is formed on the front surface (surface facing the insertion opening for the corresponding connector) of the side wall 120*c*. It is desirable to provide projection 120*e* in a position between the mounting surface 96 and the surface of the second body 120 facing the first body 110.

In addition, there is a second thick section 120*j*, which is thicker, in the back than in the front of the thick section 120*b*, on the surface facing the mounting surface 96, at the end of the second body 120 from which the end sections 122*b* extend (see FIG. 6).

The second contacts 122 are insert-molded so that one surface of each of the second contacts 122 is exposed on the same surface as the surface of each of plate sections 120A and 120B of the second body 120 opposite to the mounting surface 96 (see FIG. 7).

Details of Installation

As shown in FIG. 7, when the second body 120 is coupled with the first body 110, the thick section 110*b* of the first body 110 is sandwiched between the side walls 120*c*. The back side of the thick section 110*b* of the first body 110 makes contact with the front side of the second thick section 120*j* of the second body 120. The top face of the thick section 110*b* of the first body 110 makes contact with the bottom face of the thick section 120*b* of the second body 120. The side of the thick section 110*b* of the first body 110 makes contact with the inner side of the side wall 120*c* of the second body 120. The front side of the thick section 110*b* of the first body 110 and the front sides of the thick section 120*b* and the side wall 120*c* of the second body 120 are present on the same plane. At this time, the surface of the thick section 110*b* facing the mounting surface 96 and the surfaces of both side walls 120*c* facing the mounting surface 96 preferably come close to the mounting surface 96.

When the first body 110 with which the second body 120 has been coupled is inserted into the third body 130, the front sides of the thick sections 110*b* and 120*b* and the front sides of side walls 120*c* make contact with the back side of the third body 130. Accordingly, the surfaces of the first body 110 other than the surface facing the mounting surface 96 make contact with the second body 120 or the third body 130. Since the first body 110 is enclosed by the second body 120 and the third body 130, securing the second body 120 to the third body 130 secures the first body 110. This structure eliminates means for securing the first body 110 to the third body 130, thereby simplifying the component shape.

In this example, concave portions 130*g* and 130*h* are formed on the back side of the third body 130. The projections 110*c* and 120*e* are inserted into the concave portions 130*g* and 130*h*, respectively. The insertion of the projections 110*c* and 120*e* into the concave portions 130*g* and 130*h* determines the relative positions of the first body 110, the second body 120, and the third body 130.

The relative positions of the first body 110, the second body 120, and the third body 130 may be determined by forming concave portions instead of projections 110*c* and 120*e* in the same positions, forming projections instead of the concave portions 130*g* and 130*h* in the same positions, and mating these projections with concave portions. That is, it is enough to dispose positioning means using concave and convex mating on the back side of the third body 130 and the surfaces on the first body 110 and the second body 120 that make contact with the back side. This structure surely positions the first body 110, the second body 120, and the third body 130.

Two-Headed Plug

Figure 1:
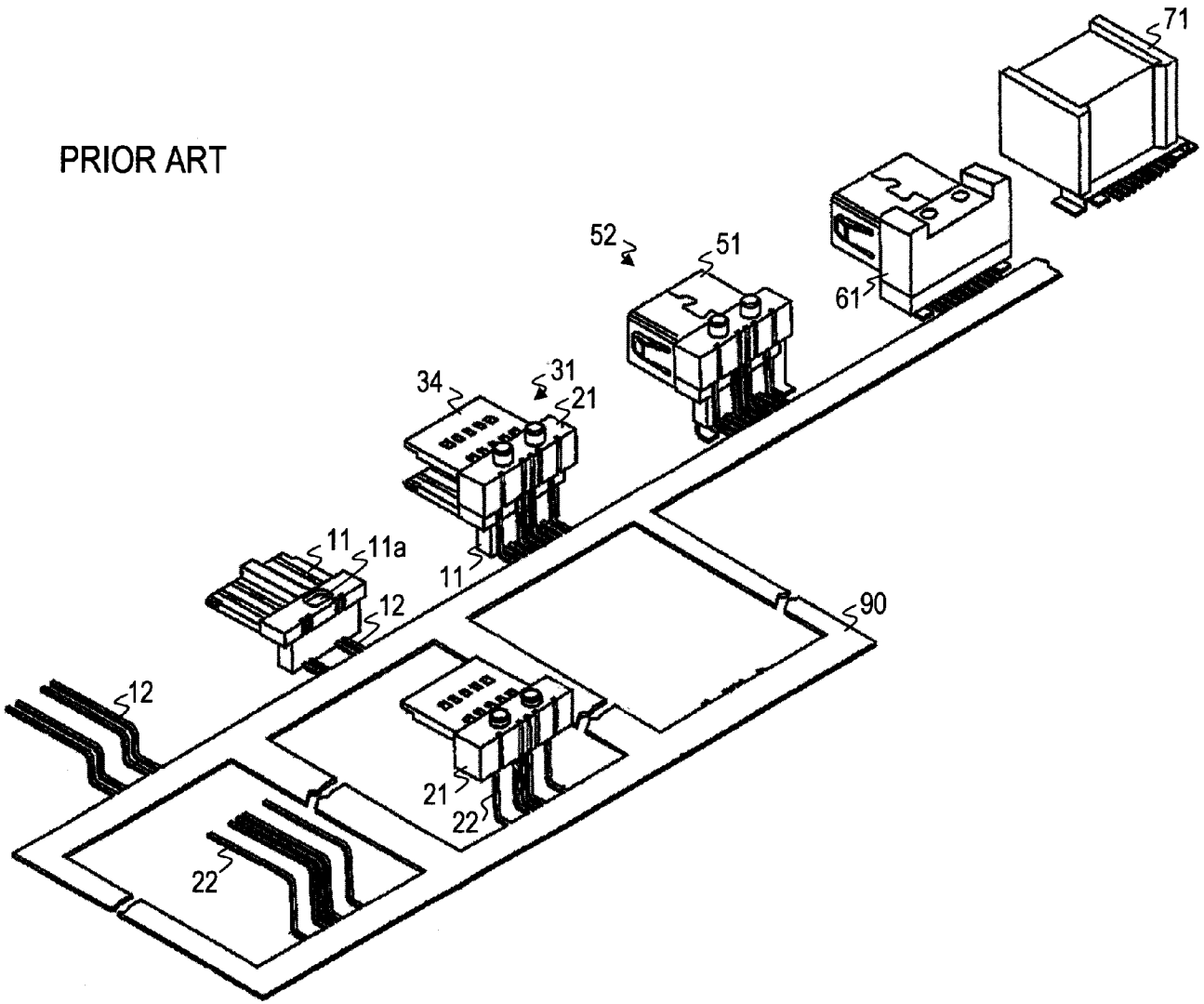
PRIOR ART FIG. 1
FIG. 1 shows the creation method and structure of a conventional surface mount multi-connector.
Figure 2:
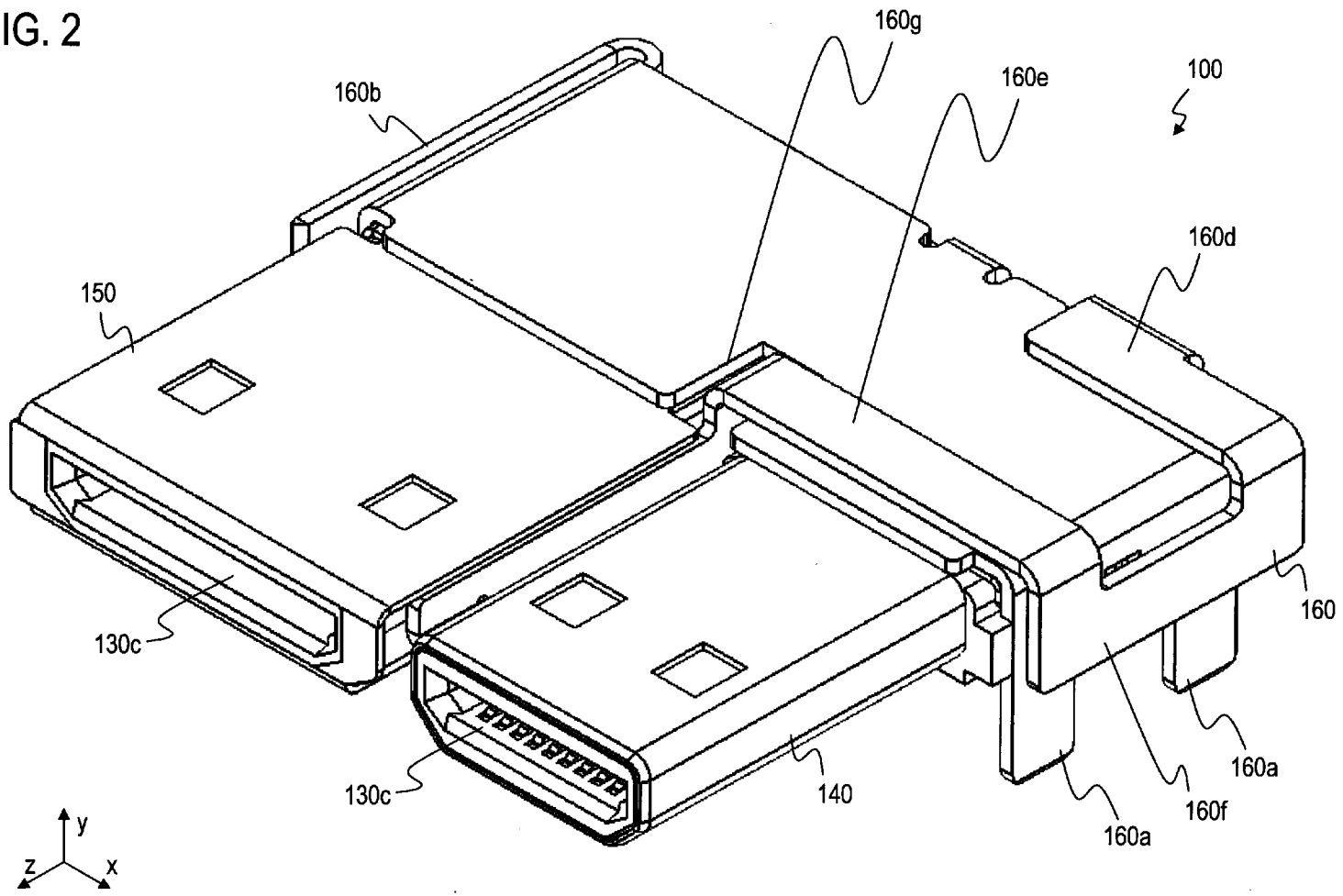
FIG. 2 is a perspective view showing the front side, right side, and top face of a surface mount multi-connector 100.

In this example, there are two insertion openings 130*c* in the third body 130 (see FIG. 2). Accordingly, the part of the first body 110 to be inserted into the third body 130 is separated into the plate sections 110A and 110B, as shown in FIG. 5. The plate sections 110A and 110B are formed integrally with each other via a connection part 110*h*, which is an extension of the thick section 110*b*. In this example, the projections 110*c* are formed at the front of the connection part 110*h*.

As shown in FIG. 6, the part of the second body 120 to be inserted into the third body 130 is also separated into the plate sections 120A and 120B. The plate section 120A is connected to the plate section 120B via a connection part 120*h*, which is located behind the thick section 120*b*. The front sides of the connection part 120*h* and the second thick section 120*j* are present on the same plane. The connection part 120*h* is formed by bending a stripe plate into U-shape. The two legs of the connection part 120*h* are connected to the two thick sections 120*b* on both sides. The middle section of the connection part 120*h* is located closer to the mounting surface 96 than the surface of each of the plate sections 120A and 120B of the second body 120 that faces the mounting surface 96. The leg of the connection part 120*h* on the side of plate section 120B extends upward until it reaches the height of the thick section 120*b* (see FIG. 7).

An angular projection 110*i*, which extends away from the mounting surface 96, is formed integrally with the connection part 110*h* of the first body 110. The back side of the angular projection 110*i* makes contact with the front side of the leg on the side of the plate section 120A of the connection part 120*h* (see FIG. 7). This structure suppresses rattles in the vertical and horizontal directions even when the width of the two-headed plug increases.

The third body 130 includes two hollow rectangular parallelepiped-like parts 130A and 130B. The plate sections 110A and 120A are inserted in the hollow rectangular parallelepiped-like part 130A. The plate sections 110B and 120B are inserted in the hollow rectangular parallelepiped-like part 130B. The hollow rectangular parallelepiped-like parts 130A and 130B are connected integrally with each other through a connection part 130*i* at their backs (see FIG. 8).

This structure allows the two-headed plug-shaped connector to be designed using the same number of components.

Ridges 110*g* and 120*g*

In this example, the first body 110 and the second body 120 are press-fits into the third body 130 with a force applied in the superimposition direction and the movable contact sections 112*a* and 122*a* are positioned in the superimposition direction.

At this time, at least one slim and low ridge 110*g* extending in the body insertion direction is desirably formed on the surface of the first body 110 opposite to the second body 120 integrally with the first body 110, and at least one slim and low ridge 120*g* extending in the body insertion direction is desirably formed on the surface of the second body 120 opposite to the first body 110 integrally with the second body 120 (see FIGS. 5 and 6). In this example, two ridges 110*g* are spaced apart on each of the plate sections 110A and 110B of the first body 110 and two ridges 120*g* are spaced apart on each of the plate sections 120A and 120B of the second body 120.

Figure 16:
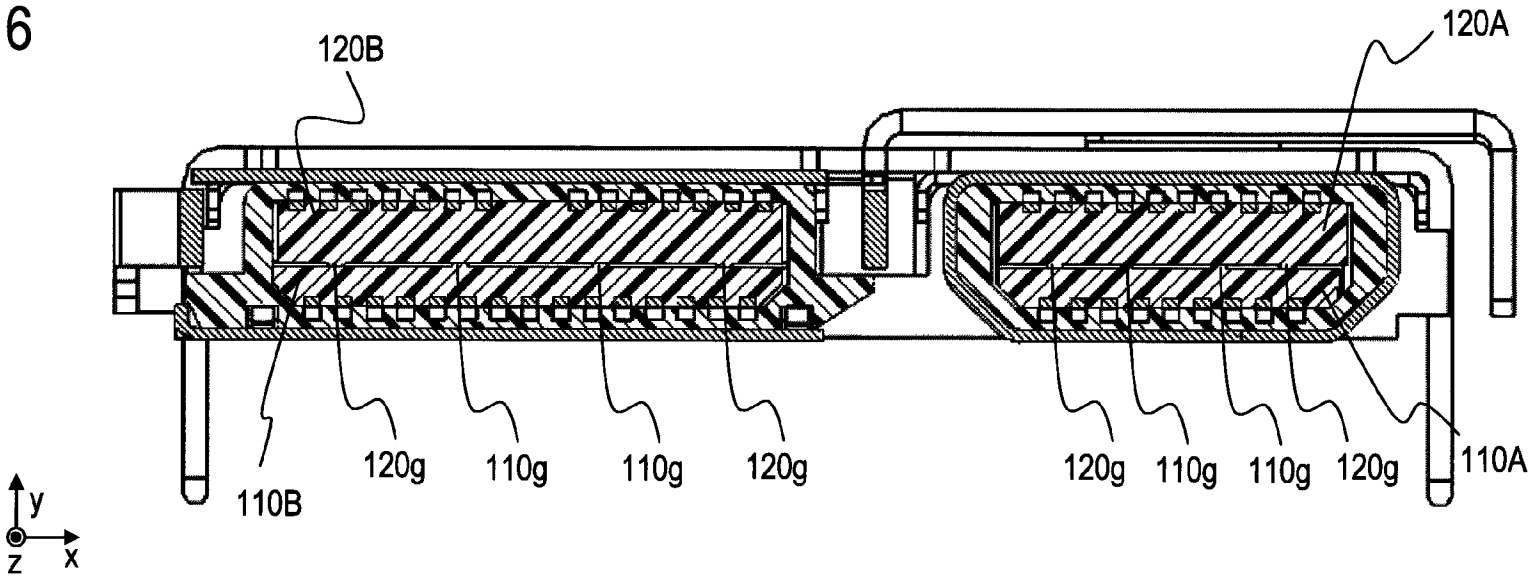
FIG. 16 is a front view of the cross section q-q' in FIG. 9.

As shown in FIG. 16, in this example, it is desirable that the two ridges 110*g* disposed on each of the plate sections 110A and 110B of the first body 110 are sandwiched between the two ridges 120*g* disposed on each of the plate sections 120A and 120B of the second body 120. In addition, the interval of the ridges 110*g* or 120*g* on each plate section is desirably the same. FIG. 16 shows the cross section q-q' in FIG. 9.

When the first body 110 and the second body 120 make contact with each other through their surfaces, if the flatness of the first body 110 and the second body 120 is large, interference may be caused. In addition, the clearance between the first body 110 with which the second body 120 has been coupled and the third body 130 is small, so it is difficult to insert the first body 110 with which the second body 120 has been coupled into the third body 130. With the structure in this example, the clearance between the first body 110 and the second body 120 can be embedded, thereby enabling positioning in the vertical direction. Even if interference between the first body 110 and the second body 120 through their mutually facing surfaces occurs, the ridges 110*g* or 120*g* are crushed to enable positioning.

First Cover 140

The third body 130 is covered with the first cover 140 and the second cover 150, which are made of metal. In this example, the hollow rectangular parallelepiped-like parts 130A and 130B of the body 130 are covered with the first cover 140 and the second cover 150, respectively.

Figure 17:
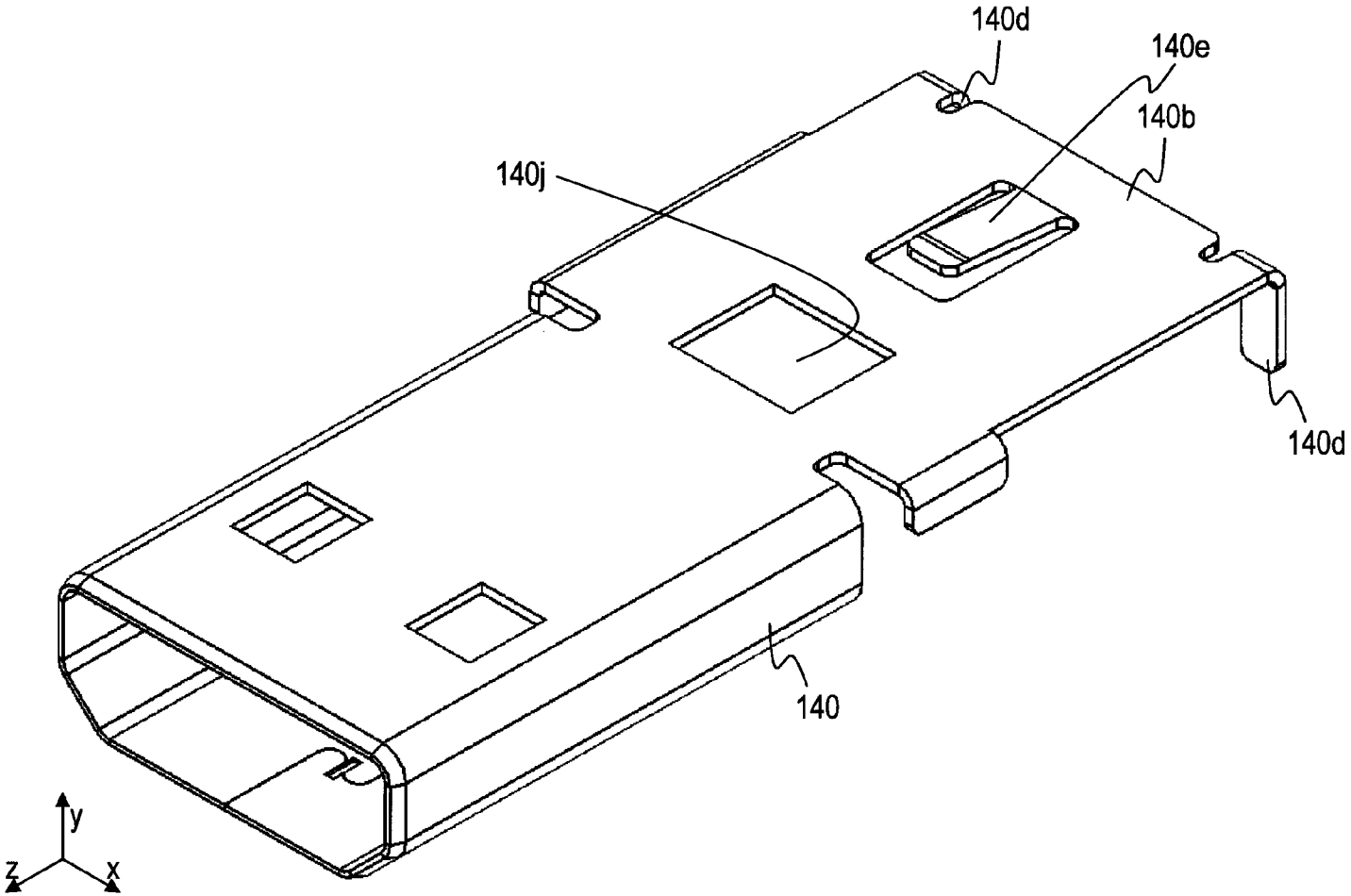
FIG. 17 is a perspective view showing the front side, right side, and top face of a first cover.

As shown in FIG. 17, the first cover 140 is created by forming a metal plate into a hollow rectangular parallelepiped. The hollow rectangular parallelepiped-like part 130A of the third body 130 is inserted into the first cover 140.

A surface of the first cover 140 that is in parallel with and more distant from the mounting surface 96 extends to the rear end of the second body 120 to form a fixing extension 140*b*. The fixing extension 140*b* extends to the rear end of the second body 120 along the surface of the second body 120 and the third body 130, which is in parallel with the mounting surface 96, and more distant from the mounting surface 96. Locking pieces 140*d* are formed on both sides at the back of the fixing extension 140*b*. The locking pieces 140*d* are bent toward the mounting surface 96. The first body 110 and the second body 120 are surely secured to the third body 130 by mechanically swaging the locking pieces 140*d*.

Second Cover 150

Figure 18:
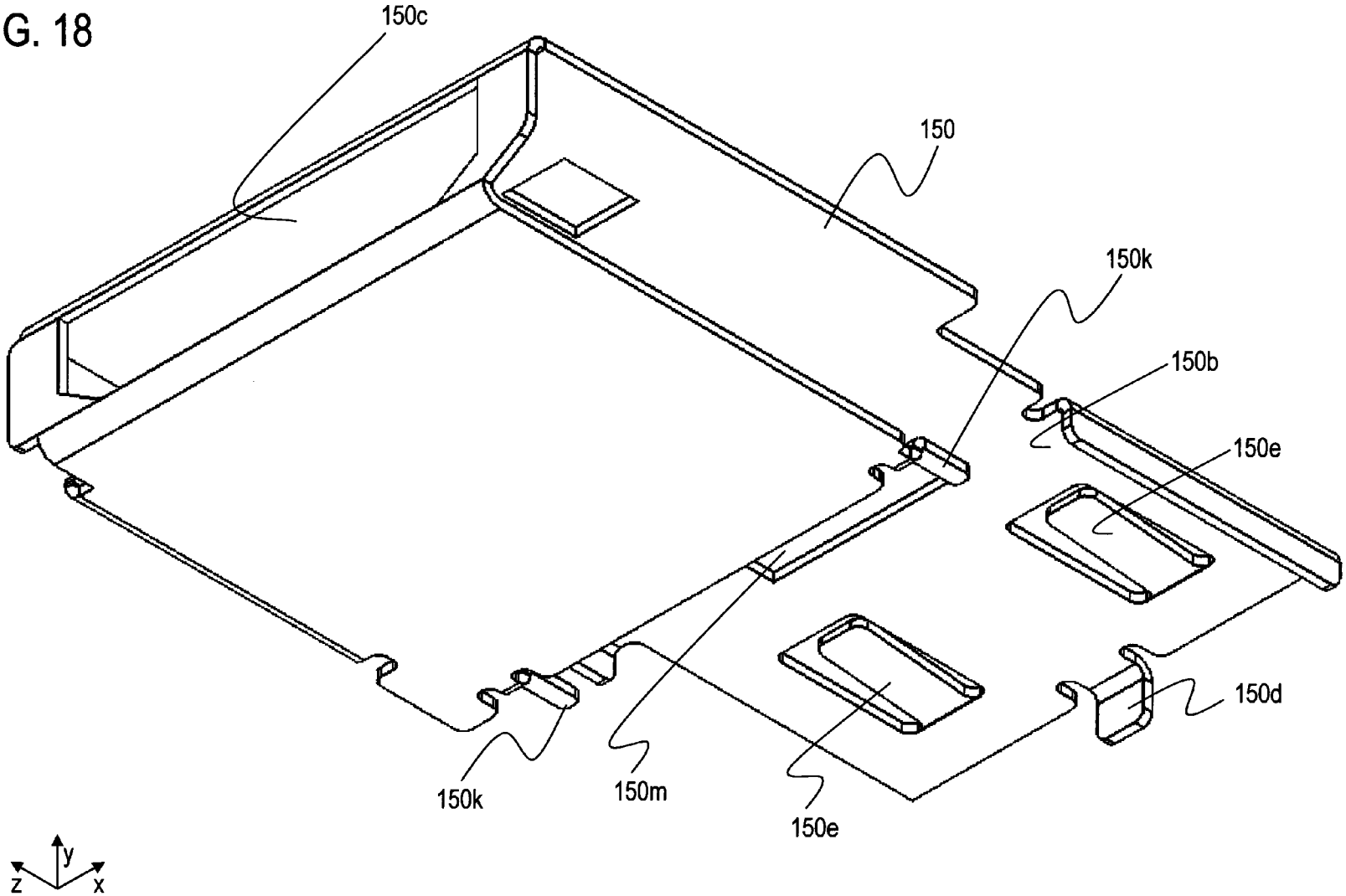
FIG. 18 is a perspective view showing the front side, right side, and bottom face of a second cover.

As shown in FIG. 18, the second cover 150 is formed by bending a metal plate into U-shape. One leg of the second cover 150 is extended backward to form a fixing extension 150*b*.

An opening 150*c* into which the corresponding connector is inserted is formed in the center. The second cover 150 is attached so as to clamp and cover the hollow rectangular parallelepiped-like part 130B of third body 130.

Figure 19:
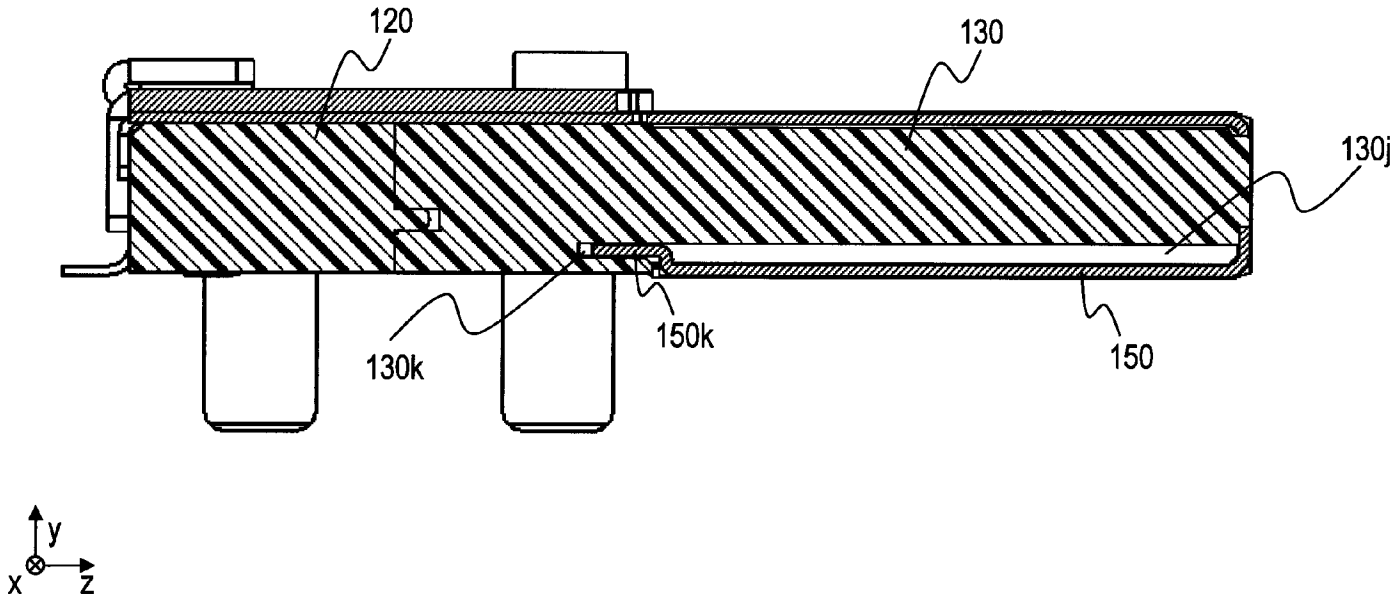
FIG. 19 is a left side view of the cross section r-r' in FIG. 9.

FIG. 19 shows the cross section r-r' in FIG. 9. A groove 130*j* is disposed in the external surface of the hollow rectangular parallelepiped-like part 130B of third body 130 that faces the mounting surface 96. The groove 130*j* is covered at the end (back wall) to form a small engaging hole 130*k*.

Small locking pieces 150*k* are formed on both sides of the other leg (on the side of the mounting surface 96) of the U-shaped second cover 150. Each of the small locking pieces 150*k* is engaged in the small engaging hole 130*k*. This structure prevents the second cover 150 from opening downward.

The fixing extension 150*b* is parallel with the mounting surface 96 and configures the surface that is more distant from the mounting surface 96. The fixing extension 150*b* extends to the rear end along the surface of the second body 120 and the third body 130, which is in parallel with the mounting surface 96, and more distant from the mounting surface 96.

A locking piece 150*d* is formed in the middle at the extending end of the fixing extension 150*b*. The locking piece 150*d* is bent toward the mounting surface 96. The first body 110 and the second body 120 are surely secured to the third body 130 by mechanically swaging the locking piece 150*d*.

The third body 130 is covered with the metal covers as described above to obtain shield effects. In this example, the hollow rectangular parallelepiped-like parts 130A and 130B of the third body 130 are covered with the first cover 140 and the second cover 150, which are mutually different components. This structure enables one shield cover (first cover 140) that covers four sides. The plug covered by the shield cover that covers four sides can be used as a transmission and reception plug for high-speed transmission signals.

Tapered Locking Parts 130*p* and 130*m* and Rectangular Openings 140*j* and 150*m*

Figure 8:
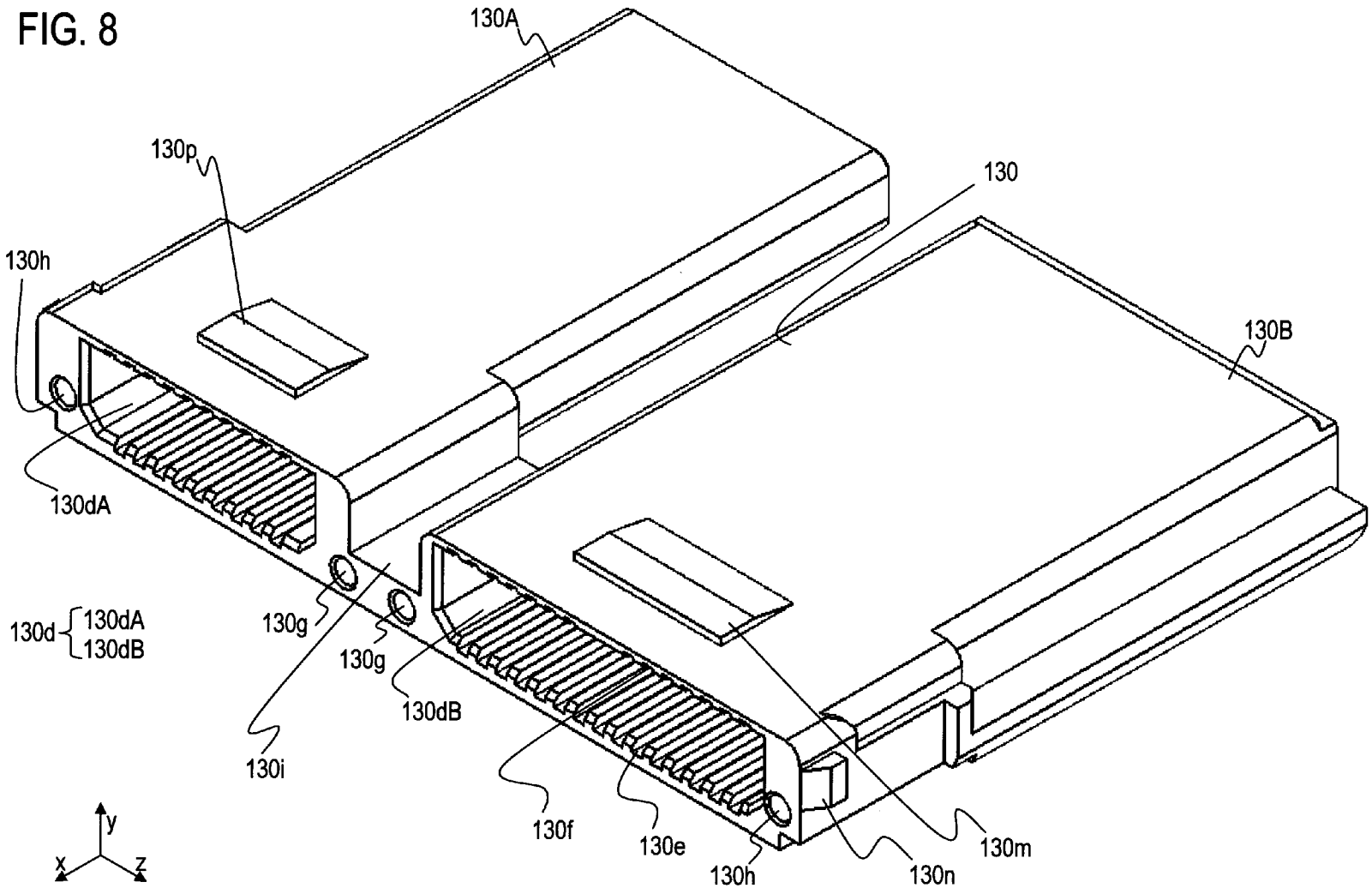
FIG. 8 is a perspective view showing the back side, left side, and top face of a third body.

In this example, low tapered locking parts 130*p* and 130*m* are formed on the external surfaces of the hollow rectangular parallelepiped-like parts 130A and 130B of the third body 130 that are opposite to the mounting surface 96 (see FIG. 8). When the tapered locking parts 130*p* and 130*m* that increase in height toward their backs are covered with the first cover 140 and the second cover 150, respectively, the tapered locking parts 130*p* and 130*m* are inserted into rectangular openings 140*j* and 150*m* disposed on the fixing extensions 140*b* and 150*b*. This structure prevents the covers from being removed forward (FIGS. 17 and 18).

Third Cover 160

Figure 20:
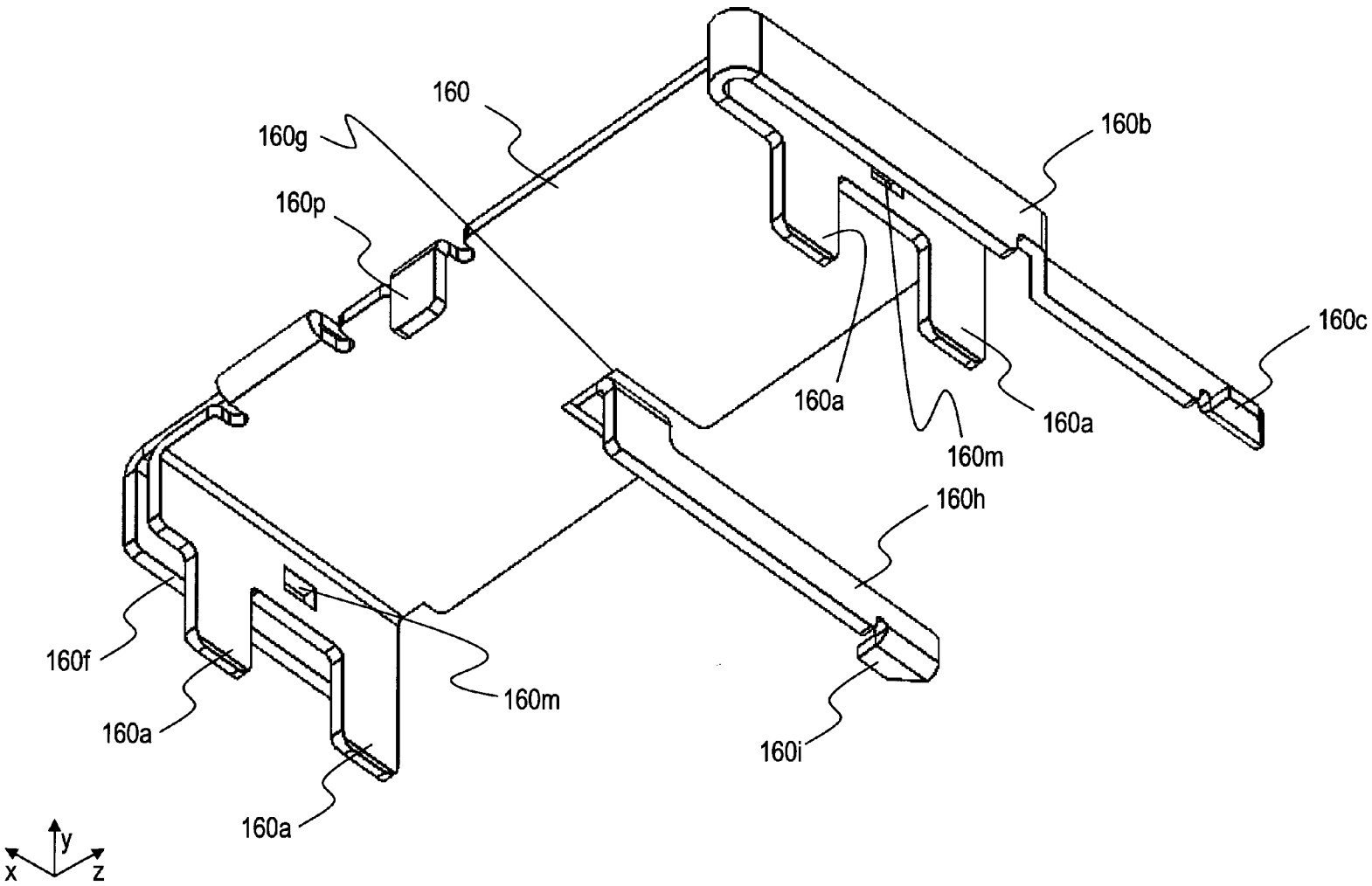
FIG. 20 is a perspective view showing the back side, left side, and bottom face of the third cover.

As shown in FIGS. 2 and 20, the third cover 160 covers the fixing extensions 140*b* and 150*b* of the first cover 140 and the second cover 150. The third cover 160 covers a surface of the second body 120 and the third body 130, which is orthogonal to the mounting surface 96, and parallel to the contacts. In addition, legs 160*a* project orthogonally to the mounting surface 96 on the both sides of the third cover 160.

Figure 21:
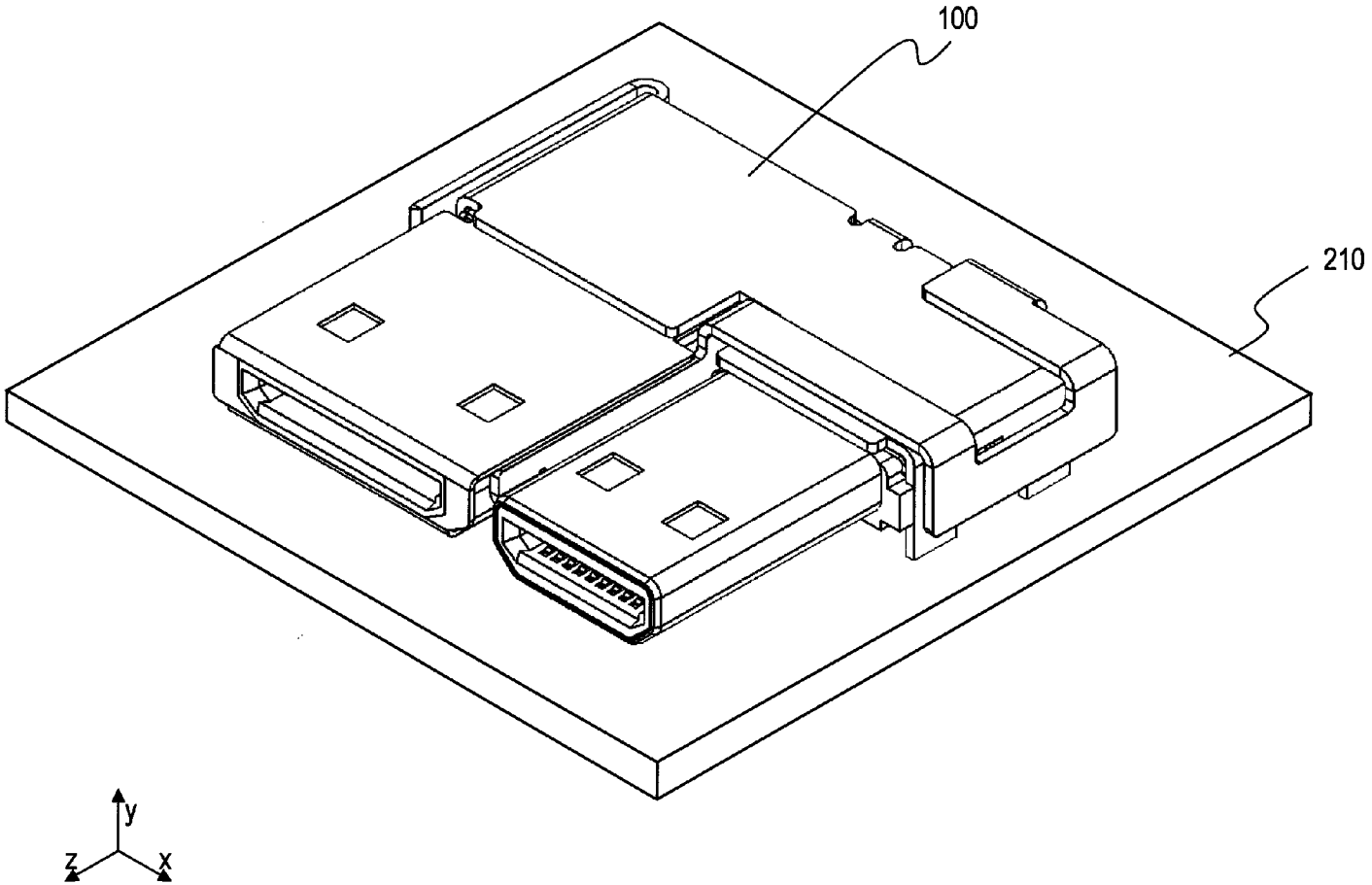
FIG. 21 is a perspective view showing the surface mount multi-connector 100 mounted on a printed circuit board.

In this example, legs 160*a* project in the front and back positions on both sides of the third cover 160. As shown in FIG. 21, the legs 160*a* are connected by soldering etc. to secure the surface mount multi-connector 100 to a printed circuit board 210.

The side wall of the third body 130 on the side of the hollow rectangular parallelepiped-like part 130B is bent from the back end to the front and then extends forward to form a locking piece 160*b*. A locking nail 160*c*, which is bent externally, is formed at the tip of the locking piece 160*b*.

In addition, both arms 160*d* and 160*e* of a U-shaped stripe plate are spaced apart along the external surface of the third cover 160. The U-shaped stripe plate is bent at a middle point 160*f* along the side wall of the hollow rectangular parallelepiped-like part 130B. The arm 160*d* near the back side is connected to the back end of the third cover 160. The end of the arm 160*e* extends to a notch 160*g* which is formed in the middle of the third cover 160. The arm 160*e* is then bent toward the mounting surface 96. The arm 160*e* extends forward in a path between the bodies to form a locking piece 160*h*. The tip of the locking piece 160*h* is bent externally to form a locking nail 160*i*.

Lower tapered locking parts 130*n* are formed on both sides of the third body 130 (see FIG. 8). When a third cover 160 is put over the lower tapered locking parts 130*n*, which increases in height toward the front, from the back to the front, the tapered locking parts 130*n* are inserted into rectangular openings 160*m* disposed on the side walls of the third cover 160. This structure prevents the third cover 160 from being removed backward.

A locking piece 160*p* is bent toward the mounting surface 96 in the middle at the back end of the third cover 160. This structure lets the locking piece 160*p* mate with the back side of the second body 120 and prevents the third cover 160 from being removed forward.

Lugs 140*e* and 150*e*, which bend obliquely from the back to the front away from the mounting surface 96, are formed on fixing extensions 140*b* and 150*b*, respectively. The lugs 140*e* and 150*e* bring the first cover 140 and the second cover 150 into secure contact with the third cover 160.

The locking piece 160*b* and 160*h* and the locking nails 160*c* and 160*i* constitute latch springs so that the latch springs are formed integrally with the third cover 160. The locking piece 160*b* and the middle point 160*f* are held and a force is applied to operate the latches. This structure increases the holding force for the unit having the corresponding receptacle, without increasing the number of parts.

The third cover 160 can be formed separately with the first cover 140 and the second cover 150. Accordingly, the third cover 160 may be formed of thicker metal material than in the first cover 140 or the second cover 150. This structure improves the mounting strength of printed circuit board. Since the plug thickness dimensions are defined for the first cover 140 and the second cover 150, the thickness of material is limited, thereby making it difficult to obtain a desired strength.

FIG. 21 shows the state where the surface mount multi-connector 100 is mounted on the printed circuit board 210 of an electric apparatus. This structure allows the electronic apparatus with a predetermined printed circuit board to use the surface mount multi-connector 100 for connection with another electronic apparatus with the corresponding connector. At this time, the holding force can be increased by providing the corresponding connector with the receptacle that mates with the latch spring formed integrally with the third cover 160.

The present invention is not limited to the above embodiments, and various modifications may be made in the embodiments without departing from the scope of the invention. For example, the surface mount multi-connector 100 may not be two-headed shaped and the shapes of the bodies and covers may be changed as necessary. In addition, the present invention can be practiced without the covers.

Effects

These structures improve the coplanarity of the connection portions 112*d* and 122*d* of the first and second contacts 112 and 122 with respect to the mounting surface 96. Since the tips 112*c* and 122*c* of the movable contacts 112*a* and 122*a* of the first and second contacts 112 and 122 mate with catching parts 130*a* and 130*b* of the third body 130 to give preload, the contact reliability can be improved.

What is claimed is:

1. A surface mount multi-connector comprising:

a first body in which a plurality of first contacts having movable contact sections and end sections that extend oppositely to each other are held by insert molding;

a second body in which a plurality of second contacts having movable contact sections and end sections that extend oppositely to each other are held by insert molding; and a third body that incorporates the first body with which the second body has been coupled so that the movable contact sections of the second contacts and the movable contact sections of the first contacts face in the same direction, wherein tips ahead of the movable contact sections of the first contacts and tips ahead of the movable contact sections of the second contacts elastically mate with catching parts formed on an inner wall of the third body, and connection portions of the end sections of the first contacts and connection portions of the end sections of the second contacts lie in a same plane;

the surface mount multi-connector further comprises a cover that covers a hollow rectangular parallelepiped-like part of the third body, the hollow rectangular parallelepiped-like part accommodating the movable contact sections of the first contacts and the movable contact sections of the second contacts, the cover has a fixing extension that extends backward;

the fixing extension has a locking piece at the end thereof;

the locking piece bends toward a mounting surface;

the surface mount multi-connector further comprises a third cover that covers the fixing extension of the cover; and legs that the third cover has on both sides project orthogonally to the mounting surface.

2. The surface mount multi-connector of claim 1, wherein a latch spring that mates with a corresponding receptacle is formed integrally with the third cover.

3. The surface mount multi-connector of claim 1 or 2, wherein the third body has two hollow rectangular parallelepiped-like parts and each of the first body and the second body is separated into two plate sections that are inserted into the two hollow rectangular parallelepiped-like parts respectively.

4. The surface mount multi-connector of claim 3, wherein the cover that covers the third body having the two hollow rectangular parallelepiped-like parts includes a first cover and a second cover, which are mutually different components.

5. The surface mount multi-connector of claim 1 or 2, wherein the surfaces of the first body other than the mounting surface make contact with the second body or the third body.

6. An electronic apparatus having the surface mount multi-connector of claim 1 or 2, wherein the surface mount multi-connector is mounted on a printed circuit board.

* * * * *